US005263873A

United States Patent [19]

Landries

[11] Patent Number: 5,263,873

[45] Date of Patent: Nov. 23, 1993

[54] ELECTRICAL PLUG CONNECTOR WITH ANTIBUNCHING FEATURE

[75] Inventor: Richard V. Landries, Cortland, Ohio

[73] Assignee: General Motors Corporation, Detroit, Mich.

[21] Appl. No.: 857,131

[22] Filed: Mar. 24, 1992

[51] Int. Cl.[5] ..... H01R 13/52

[52] U.S. Cl. ..... 439/271; 439/272

[58] Field of Search ..... 439/271-283, 439/587

[56] References Cited

U.S. PATENT DOCUMENTS

| | | | |
|---|---|---|---|
| 4,767,350 | 8/1988 | Cooper et al. | 439/271 |
| 4,822,294 | 4/1989 | McClearn | 439/274 |
| 4,874,325 | 10/1989 | Bensing et al. | 439/272 |
| 4,917,620 | 4/1990 | Samejima et al. | 439/271 |
| 4,921,437 | 5/1990 | Cooper et al. | 439/275 |
| 5,116,236 | 5/1992 | Colleran et al. | 439/271 |

*Primary Examiner*—David L. Pirlot

*Attorney, Agent, or Firm*—Francis J. Fodale; William A. Schuetz

[57] ABSTRACT

An electrical plug connector has a plug portion that extends to an integral medial annular flange that serves as a pilot and stop for a shroud of a mating electrical socket connector. The flange has a forward stop shoulder of reduced height that forms a ledge, and a pair of vertically spaced retainer lips that are integrally attached to the ledge and that extend forwardly of the ledge in an axial direction. The electrical plug connector includes an elastomeric interface seal for forming a seal between the plug portion and the shroud of the mating electrical socket connector that comprises an annular body and a plurality of flexible sealing lips that biasingly engage an inner surface of the shroud when the electrical plug connector is plugged in. The annular body of the elastomeric seal is mounted on the plug portion with its trailing axial end against the stop shoulder of the flange and beneath the retainer lips so that the elastomeric seal cannot ridge over the flange and bunch when the electrical plug connector is plugged into the mating electrical socket connector.

3 Claims, 1 Drawing Sheet

ELECTRICAL PLUG CONNECTOR WITH ANTIBUNCHING FEATURE

BACKGROUND OF THE INVENTION

This invention relates generally to electrical connectors and more specifically to electrical plug connectors that have an interface seal in the form of an elastomeric annulus.

U.S. Pat. No. 4,822,294 granted to Lisa J. McClearn Apr. 18, 1989 discloses a sealing grommet assembly for a wiring harness that includes mating electrical plug and socket connectors (22) and (24) having an interface seal of elastomeric material. The interface seal comprises an annular body that is mounted on the plug portion of the electrical plug connector (22) with its trailing axial end against a stop shoulder as best shown in FIG. 3 of the patent. This interface seal further comprises a plurality of flexible radial lips that extend radially outwardly of the annular body. The flexible radial lips are deflected into biased sealing engagement with an inner surface of a shroud of the mating electrical socket connector (24) when the electrical plug connector (22) is plugged in as shown in FIG. 4 of the patent.

See also U.S. Pat. No. 4,874,325 granted to Gregory L. Bensing, Joseph H. Gladd, and John A. Yurtin Oct. 17, 1989 for an electrical connector with an interface seal and U.S. Pat. No. 4,921,437 granted to Ralph M. Cooper, Dana Hollingsworth, John P. Kunkle and Donald G. Stillie May 1, 1990 for a sealed electrical connector assembly with a terminal retainer.

An ongoing problem with interface seal arrangements of the above noted type is seal bunching, especially when the elastomeric seal has a long span. Seal bunching occurs when the trailing axial end of the annular body rides up over the stop shoulder of the electrical plug connector body when it is plugged into the mating socket connector body. This allows the trailing axial end portion of the elastomeric seal to squirt out the open end of the shroud which results in a high engagement force requirement and a potential seal leakage problem.

SUMMARY OF THE INVENTION

The object of this invention is to provide an improved arrangement for matable electrical plug and socket connectors having annular elastomeric interface seals that eliminates bunching of the annular elastomeric interface seal when the electrical plug connector is plugged into the mating electrical socket connector.

Another object of this invention is to provide an improved arrangement for mounting an annular elastomeric interface seal on an electrical plug connector that does not require any modification of the mating electrical socket connector to eliminate bunching of the annular elastomeric seal when the electrical plug connector is plugged into the mating electrical socket connector.

A feature of this invention is that the electrical plug connector body has retaining structure that prevents the trailing axial end of the elastomeric seal body from riding up over the stop shoulder to eliminate bunching of the annular elastomeric seal when the electrical plug connector is plugged into a mating electrical socket connector.

Another feature of this invention is that an annular elastomeric interface seal is mounted on an electrical plug connector body to eliminate bunching of the annular elastomeric interface in such a way that a mating electrical socket connector does not require any modification.

other objects and features of the invention will become apparent to those skilled in the art as disclosure is made in the following detailed description of a preferred embodiment of the invention which sets forth the best mode of the invention contemplated by the inventor and which is illustrated in the accompanying sheet(s) of drawing.

DETAILED DESCRIPTION OF THE PREFERRED EMBODIMENT

Figure 1:
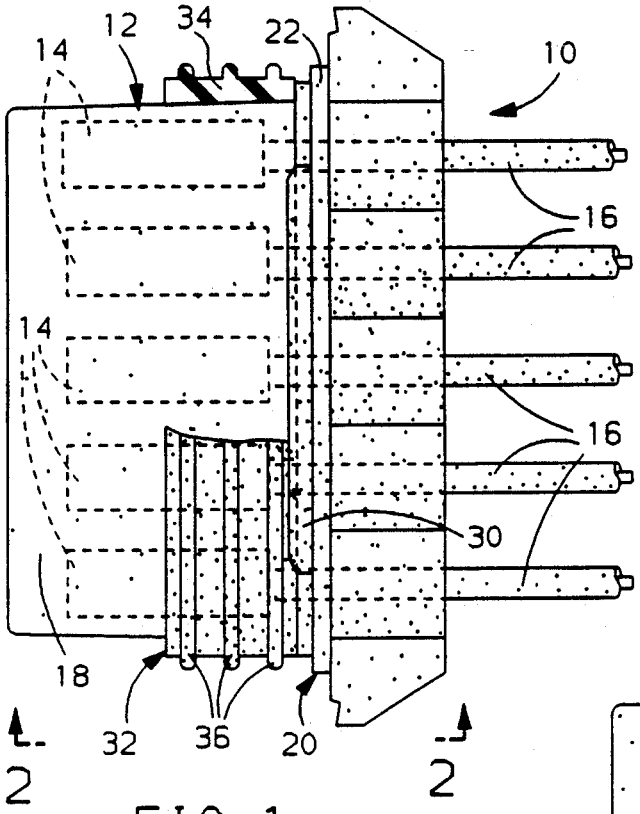
FIG. 1 is a plan view of an electrical plug connector having an annular elastomeric interface seal in accordance with this invention.

Referring now to the drawing, an electrical plug connector 10 comprises a connector body 12 of electrical insulative material, usually a thermoplastic such as a nylon. The connector body 12 houses a plurality of electrical terminals 14 that are illustrated schematically and that are attached to electric cables 16 that extend out of an axial or longitudinal end of the connector body 12. The schematically illustrated electrical terminals 14 may be of conventional constructions such as shown in the three U.S. Patents discussed above and the electrical terminals 14 may be attached to the electric cables 16 in a conventional manner using well known crimping techniques.

The plug connector body 12 has a plug portion 18 at its mating or opposite axial end. The plug portion 18 extends rearwardly to an integral medial annular flange 20 that extends radially outwardly of the plug portion 18. The shapes of the plug portion 18 and the annular flange 20 are oval, that is, each is generally rectangular with round corners.

Figure 2:
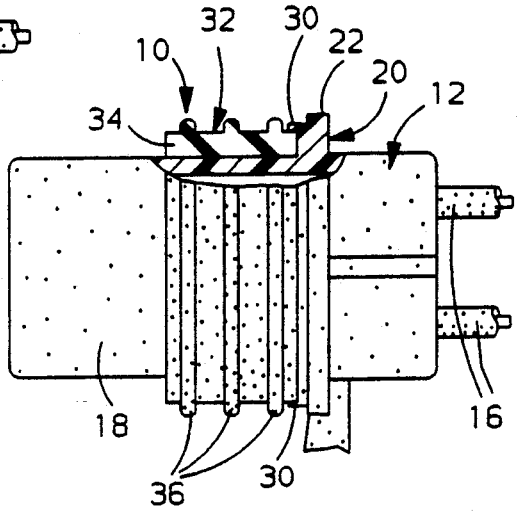
FIG. 2 is a partially sectioned side view of the electrical plug connector shown in FIG. 1.
Figure 3:
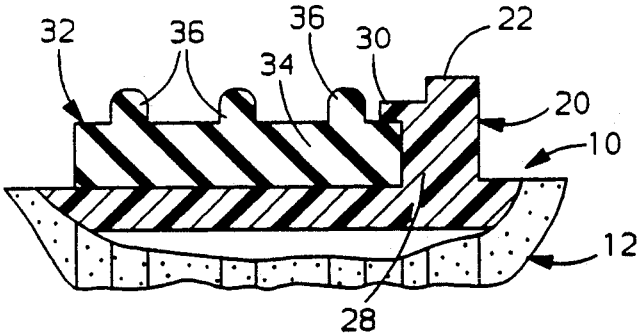
FIG. 3 is an enlargement of a portion of FIG. 2.
Figure 4:
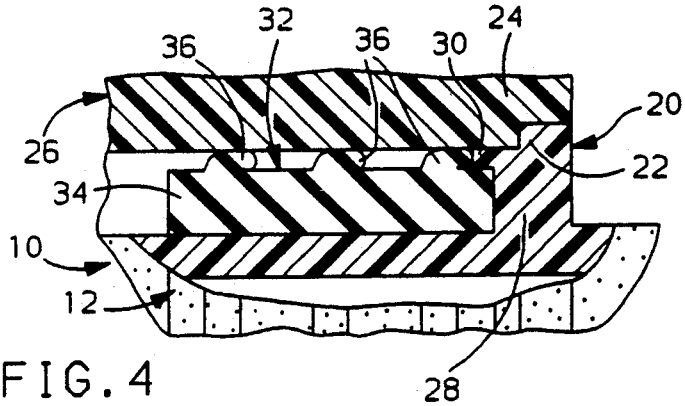
FIG. 4 is similar to FIG. 3 showing the electrical plug connector plugged into a mating electrical socket connector.

The annular flange 20 has an outer portion 22 that serves as a pilot and stop for a shroud 24 of a mating electrical socket connector 26 as shown in FIG. 4. The annular flange 20 also has a forward stop shoulder 28 of reduced height that forms an oval shaped ledge. The annular flange 20 further comprises a pair of vertically spaced retainer lips 30 that are integrally attached to the opposite major sides of the oval shaped ledge. The retainer lips 30 are long in the lateral direction as shown in FIG. 1 and extend forwardly of the ledge for a short distance as shown in FIGS. 2, 3 and 4.

The electrical plug connector 10 further comprises an elastomeric interface seal 32 that forms a seal between the plug portion 18 and the shroud 24 when the electrical plug connector 10 is plugged into the electrical socket connector 26 as shown in FIG. 4. The elastomeric interface seal 32 comprises an annular body 34 that has a plurality of flexible sealing lips 36 that extend radially outwardly of the annular body 34 as shown in FIGS. 2 and 3 so that the flexible sealing lips 36 biasingly engage an inner surface of the shroud 24 when the electrical plug connector 10 is plugged in as shown in FIG. 4.

The annular body 34 of the elastomeric seal 32 is mounted on the plug portion 18 with its trailing axial end against the short stop shoulder 28 of the annular oval shaped flange 20. The trailing axial end of the annular body 34 is beneath the upper and lower retainer lips 30 so that the elastomeric seal 32 cannot ride up over the flange 22 and bunch when the electrical plug connector 10 is plugged into the electrical socket connector 26. The vertically spaced retainer lips 30 are a modification of an otherwise known electrical plug connector produced by the Packard Electric Division of General Motors Corporation. The electrical socket connector 26, per se, is also a known design of General motors Corporation. It does not require any modification for use with the electrical plug connector 10.

I wish it to be understood that I do not desire to be limited to the exact details of construction shown and described, for obvious modifications will occur to a person skilled in the art.

The embodiments of the invention in which an exclusive property or privilege is claimed are defined as follows:

1. An electrical plug connector comprising:

a connector body having a plug portion adjacent one axial end that extends rearwardly to an integral medial annular flange that extends radially outwardly of the plug portion;

the annular flange having an outer portion that serves as a pilot and stop for a shroud of a mating electrical socket connector, a forward stop shoulder of reduced height that forms an oval shaped ledge, and vertically spaced retainer lips that are integrally attached to the oval shaped ledge along its major sides and that extend forwardly of the oval shaped ledge for a short distance in an axial direction; and an elastomeric interface seal for forming a seal between the plug portion and an internal surface of the shroud of a mating electrical socket connector when the electrical plug connector is plugged into the electrical socket connector;

the elastomeric interface seal having an annular body that has a plurality of axially spaced flexible sealing lips that extend radially outwardly of the annular body at locations free from said retainer lips so as to biasingly engage the inner surface of the shroud when the electrical plug connector is plugged in;

the annular body of the elastomeric seal being mounted on the plug portion with one of its axial ends against the stop shoulder of the flange and beneath the vertically spaced retainer lips so that the elastomeric seal cannot ride up over the flange and bunch when the electrical plug connector is plugged into the mating electrical socket connector.

2. An electrical plug connector comprising:

a connector body having a plug portion adjacent one axial end that extends rearwardly to an internal medial annular flange that extends radially outwardly of the plug portion;

the annular flange having an outer portion that serves as a pilot and stop for a shroud of a mating electrical socket connector, a forward stop shoulder of reduced height that forms a ledge, and spaced retainer lips that are integrally attached to the ledge and that extend forwardly of the ledge in an axial direction; and an elastomeric interface seal for forming a seal between the plug portion and a shroud of a mating electrical socket connector when the electrical plug connector is plugged into the electrical socket connector;

the elastomeric interface seal having an annular body that has a plurality of flexible axially spaced sealing lips that extend radially outwardly of the annular body at locations free from said spaced retainer lips so as to biasingly engage an inner surface of the shroud when the electrical plug connector is plugged in;

the annular body of the elastomeric seal being mounted on the plug portion with one of its axial ends against the stop shoulder of the flange and beneath the spaced retainer lips so that the elastomeric seal cannot ride up over the flange and bunch when the electrical plug connector is plugged into a mating electrical socket connector.

3. An electrical plug connector comprising:

a connector body having a plug portion adjacent one axial end that extends rearwardly to an integral medial annular flange that extends radially outwardly of the plug portion;

the annular flange having a forward stop shoulder and at least one retainer lip that is integrally attached to the stop shoulder and that extends forwardly of the stop shoulder in an axial direction; and an elastomeric interface seal for forming a seal between the plug portion and a shroud of a mating electrical socket connector when the electrical plug connector is plugged into the electrical socket connector;

the elastomeric interface seal having an annular body that has at least one annular flexible sealing lip that extends radially outwardly of the annular body at a location free from said retainer lip so as to biasingly engage an inner surface of the shroud when the electrical plug connector is plugged in;

the annular body of the elastomeric seal being mounted on the plug portion with one of its its axial ends against the stop shoulder of the flange and beneath the retainer lip so that the elastomeric seal cannot ride up over the flange and bunch when the electrical plug connector is plugged into a mating electrical socket connector.

* * * * *